United States Patent [19]

Swallow

[11] 4,089,068

[45] May 16, 1978

[54] APPAREL WITH BELT ASSEMBLY

[75] Inventor: Roger T. Swallow, Crystal Lake, Ill.

[73] Assignee: The Kendall Company, Boston, Mass.

[21] Appl. No.: 799,481

[22] Filed: May 23, 1977

Related U.S. Application Data

[62] Division of Ser. No. 676,607, Apr. 13, 1976, Pat. No. 4,054,952.

[51] Int. Cl.[2] ..... A41B 9/14

[52] U.S. Cl. ..... 2/76; 2/221; 2/237; 2/240; 2/DIG. 6

[58] Field of Search ..... 2/76, 221, 237, 240, 2/DIG. 6, DIG. 7; 24/204, 211 R, 3 R, DIG. 18

[56] References Cited

U.S. PATENT DOCUMENTS

| | | | |
|---|---|---|---|
| 1,638,073 | 8/1927 | Van Heusen | 24/3 R |
| 3,027,566 | 4/1962 | Ruby | 2/237 |
| 3,128,476 | 4/1964 | Lash | 2/DIG. 6 |
| 3,164,844 | 1/1965 | Ruby | 2/221 |
| 3,461,511 | 8/1969 | Perina | 24/204 X |
| 3,475,810 | 11/1969 | Mates | 24/211 R X |
| 3,777,435 | 12/1973 | Perina | 24/204 X |

*Primary Examiner*—H. Hampton Hunter
*Attorney, Agent, or Firm*—Powell L. Sprunger

[57] ABSTRACT

A belt assembly comprising, a housing having an elongated tunnel, and an elongated belt passing through the housing tunnel. The housing and belt have cooperating surface restraining means interengaging in the housing tunnel and providing substantial restraint against movement of the belt through the housing tunnel, with the surface means permitting movement of the belt through the housing tunnel responsive to relatively large forces applied against the belt.

9 Claims, 16 Drawing Figures

APPAREL WITH BELT ASSEMBLY

This is a division of application Ser. No. 676,607 filed Apr. 13, 1976 now U.S. Pat. 4,054,952.

BACKGROUND OF THE INVENTION

The present invention relates to belt assemblies.

A number of belt structures have been proposed in the past for assorted purposes, such as for closing or adjusting garments. In general, the prior art belt structures or assemblies are inconvenient and cumbersome in use, and normally require manipulation of a mechanical member, removal of part of the assembly from the garment, or relatively tedious handling of the assembly in order to accomplish adjustment of the belt. Thus, there exists a need for a belt assembly which is extremely simple and convenient in operation.

SUMMARY OF THE INVENTION

A principal feature of the present invention is the provision of a belt assembly of economic construction which permits adjustment of the assembly in a simplified manner.

The belt assembly of the present invention comprises, a housing having first and second walls defining an elongated tunnel in the housing, with the first wall having first surface restraining means in the housing. The belt assembly has an elongated belt passing through the housing tunnel and having second surface restraining means facing the first surface means, with the size of the tunnel between the first and second walls being sufficiently small relative the thickness of the belt for the second wall to maintain the second surface means of the belt in close engagement with the first surface means of the housing.

A feature of the present invention is that the first and second surface means interengage and cooperate to provide substantial restraint against movement of the belt through the housing tunnel.

Another feature of the invention is that the first and second surface means release sufficiently to permit movement of the belt through the housing tunnel responsive to relatively large forces applied against the belt.

Thus, a feature of the present invention is that the belt may be readily adjusted relative the housing by merely tugging on the belt while holding the tunnel.

Another feature of the present invention is that the first and second surface means normally retain the belt at a selected position in the housing.

Yet another feature of the present invention is that in an embodiment the first and second surface means comprise hook and loop fastening strips.

Still another feature of the present invention is that in another embodiment the first and second surface means comprise a cohesive-adhesive material.

A further feature of the present invention is the provision of garments for convenient use with the belt assembly of the present invention.

Another feature of the invention is the provision of means for releasably attaching the housing to the garment.

Yet another feature of the invention is the provision of means for opening and releasably closing the housing.

Further features will become more fully apparent in the following description of the embodiments of this invention and from the appended claims.

DESCRIPTION OF THE PREFERRED EMBODIMENTS

Figure 1:
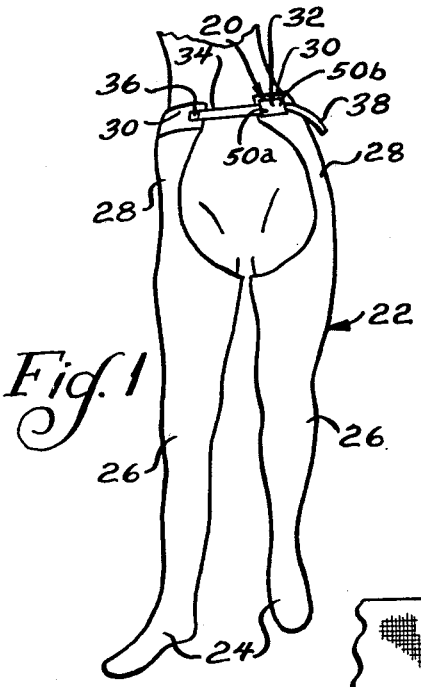
FIG. 1 is a perspective view of a belt assembly of the present invention as positioned on a therapeutic stocking.

Referring now to FIG. 1, there is shown a belt assembly generally designated 20 as attached to a therapeutic stocking 22. Although for convenience the belt assembly 20 will be discussed in connection with the stocking 22, it will be apparent that the belt assembly of the present invention has many applications, and may be utilized on any suitable article or garment, such as disposable gown, as will be discussed below. As shown, the stocking 22 has a pair of foot portions 24, a pair of boot portions 26 for covering the legs of the wearer, a pair of hip portions 28 extending along the hips of the wearer, and a pair of waist portions 30 at the upper end of the hip portions 28 for placement adjacent the wearer's waist. As discussed in copending application Ser. No. 593,159, filed July 3, 1975, incorporated herein by reference, the stocking boot portions 26 exert a compressive pressure against a patient's leg which gradually decreases from the ankle toward the upper part of the leg, in order to minimize the possibility of thromboembolism.

As shown in FIG. 1, the belt assembly 20 has a housing 32 attached to one waist portion 30 of the stocking 22, and an elongated belt 34 passing through the housing 32 and having one end 36 attached to the other waist portion 30 of the stocking 22. As will be seen below, the belt 34 may be adjusted in the housing 32 by pulling the outer end 38 of the belt 34 in order to tighten the waist portions 30 about the wearer, and may be adjusted by tugging on the portion of the belt 34 intermediate its one end 36 and the housing 32 in order to loosen the stocking about the wearer.

Figure 4:
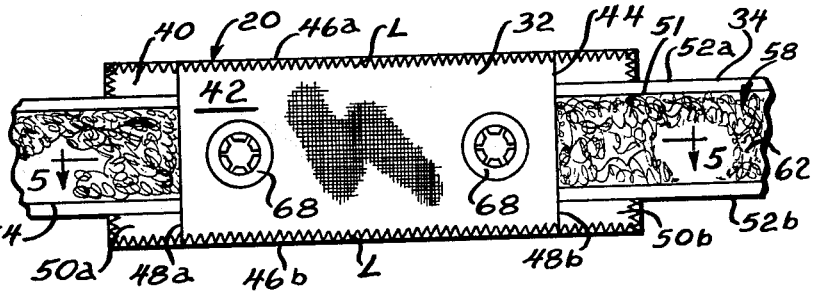
FIG. 4 is a fragmentary back plan view of the belt assembly of FIG. 3.
Figure 5:
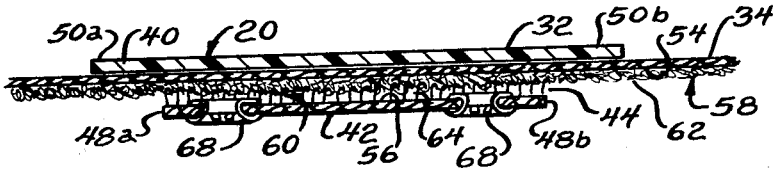
FIG. 5 is a fragmentary sectional view taken substantially as indicated along the line 5—5 of FIG. 4.

Referring to FIGS. 3–6, the housing 32 has an elongated outer section 40, and an elongated inner section 42, with the sections 40 and 42 defining walls of the housing and an elongated tunnel 44 in the housing. The sections 40 and 42 may be made of any suitable material which provide sufficient durability for the housing 32. For example, the outer section 40 may be made of a vinyl material which is durable and which provides an aesthetically pleasing outer surface for the housing 32. The inner section 42 may be made of a durable fabric or other material, as desired. The outer and inner sections 40 and 42, respectively, are attached together along their side edges 46*a* and 46*b* by any suitable means, such as by lines of stitching L. As best shown in FIGS. 4 and 5, the outer section 40 extends past both end edges 48*a* and 48*b* of the inner section 42 to define a pair of opposed grasping tabs 50*a* and 50*b* of the outer section 40 for a purpose which will be described below.

Figure 6:
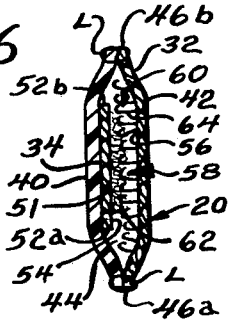
FIG. 6 is a sectional view taken substantially as indicated along the line 6—6 of FIG. 3.

As illustrated in FIGS. 3–6, the belt 34 has an elongated backing 51 defining a pair of side edges 52*a* and 52*b*, and passes through the tunnel 44 of the housing 32. In a preferred form the backing 51 is elastic in its longitudinal direction, although it may be inelastic, as desired. Referring to FIGS. 4–6, the belt 34 has a surface 54 facing toward an inner surface 56 of the inner section 42, with the surfaces 54 and 56 having interengaging surface restraining means 58 and 60, respectively. In the embodiment shown, the belt surface means 58 comprises an elongated loop or female fastening strip 62, while the housing surface means 60 comprises a hook or male fastening strip or segment 64. As shown in FIGS. 5 and 6, the dimensions of the housing tunnel 44 between the outer and inner sections 40 and 42, respectively, are sufficiently small such that the outer section 40 urges the belt 34 toward the inner section 42 of the housing, and maintains the hook and loop fastening strips 64 and 62, respectively, in close engagement with each other in the housing tunnel 44. The hook and loop fastening strips are of a type known to the art, such as VELCRO, and are commonly used as fastening elements.

Figure 2:
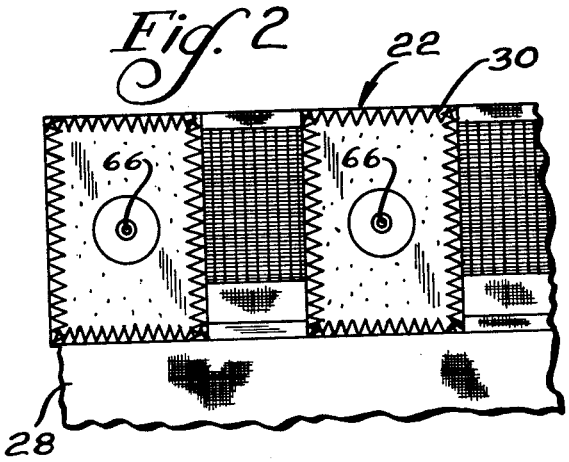
FIG. 2 is a fragmentary plan view of a waist portion of the stocking of FIG. 1.
Figure 3:
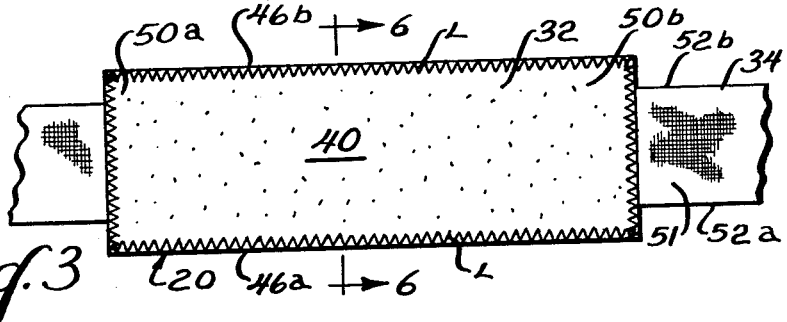
FIG. 3 is a fragmentary front plan view of the belt assembly of FIG. 1.

As illustrated in FIGS. 2, 4, and 5, one waist portion 30 of the stocking 22 has a pair of male snap fasteners 66, while the inner section 42 of the housing 32 has a pair of associated female snap fasteners 68. Thus, with reference to FIG. 1, the housing 32 may be releasably attached to the one stocking waist portion 30 by pressing the housing against the waist portion 30 while the female snap fasteners 68 are aligned with the male fasteners 66.

In use of the belt assembly 20, the interengaging hook and loop fastening strips 64 and 62, respectively, provide substantial resistance or restraint against movement of the belt 34 through the housing tunnel 44. Such restraint is assured by the outer section 40 of the housing 32 which maintains the cooperating surface means of the belt and inner housing section in close relationship with each other. Thus, once the belt has been adjusted in the housing 32, the belt remains at the selected position during normal use of the belt assembly and stocking. When it is desired to tighten the waist portions 30 about the wearer, the wearer merely grasps the housing grasping tab 50*a* and pulls on the belt end 38 until sufficient forces have been applied against the belt to release the interengaging hook and loop fastening strips, at which time the belt 34 moves through the housing 32. After the belt has been adjusted to the desired position, the belt end 38 is released. The hook and loop fastening strips again assume their interengaging relationship and provide resistance against movement of the belt through the housing, thus maintaining the belt at the selected position. When it is desired to loosen the stocking waist portions 30 about the wearer's waist, the wearer merely grasps the other grasping tab 50*b* and pulls on the belt portion intermediate the belt end 36 and the housing 32. When sufficient forces have been applied to the belt, the interengaging hook and loop fastening strips release and the belt 34 passes through the housing 32 until the desired tension has been obtained. Again, the wearer releases the belt, and the belt assembly maintains the belt at the selected position. Thus, the belt assembly 20 of the present invention permits easy and quick adjustment of the belt relative the housing by merely tugging on the belt, and the belt may be placed at a desired position by merely releasing the belt at the selected position.

Figure 7:
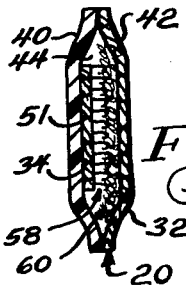
FIG. 7 is a sectional view of another embodiment of the belt assembly of the present invention.

Another embodiment of the present invention is illustrated in FIG. 7, in which like reference numerals designate like parts. In this embodiment, the surface restraining means 58 of the belt 34 comprises a hook or male fastening strip, while the surface restraining means 60 of the inner section 42 comprises a loop or female fastening strip in the housing tunnel 44. As before, the user merely tugs on the belt 34 to adjust the belt in the housing, and the hook and loop fastening strips interengage in the housing tunnel to maintain the belt at a selected position after release of the belt.

Figure 8:
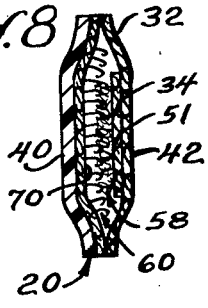
FIG. 8 is a sectional view of another embodiment of the belt assembly of the present invention.

Another embodiment of the present invention is illustrated in FIG. 8, in which like reference numerals designate like parts. In this embodiment, the belt surface means 58 faces the outer section 40 of the housing 32, and the cooperating housing surface means 60 is located on the inner surface 70 of the outer section 40. In the embodiment shown, the surface means 60 on the outer housing section 40 comprises a hook fastening strip or segment, while the surface means 58 of the belt 34 comprises a loop fastening strip. The hook and loop fastening strips interengage and cooperate to permit selective adjustment of the belt in the housing tunnel, as previously described.

Figure 9:
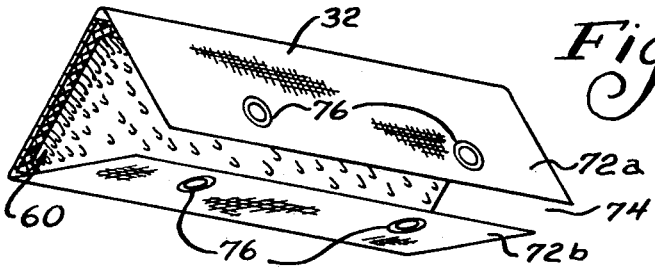
FIG. 9 is a perspective view of a housing for an embodiment of the belt assembly of the present invention.

An alternative embodiment of the housing 32 for the belt assembly of the present invention is illustrated in FIG. 9, in which like reference numerals designate like parts. In this embodiment, the housing 32 has a pair of end sections 72*a* and 72*b* defining an opening 74 to permit placement of the housing 32 over the belt with the surface means 60 of the housing 32 in engagement with the cooperating surface means of the belt. The end sections 72*a* and *b* have a plurality of snap fasteners 76, or other suitable means, to permit closure of the end sections 72*a* and *b* around the belt. When the end sections 72*a* and *b* of the housing 32 have been secured together around the belt, the end sections 72*a* and *b* of the housing 32 define a wall of the housing, and the housing defines a closely spaced tunnel for retaining the belt in the housing, such that the surface means of the housing and belt are maintained in cooperative engagement, as previously described.

Figure 10:
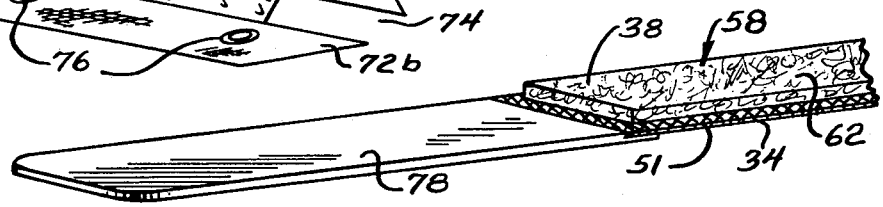
FIG. 10 is a fragmentary perspective view of a belt end for the belt assembly of the present invention.

In an alternative form, as shown in FIG. 10, the belt 34 may have a relatively rigid threading member or element 78 attached to the outer end 38 of the belt 34.

The threading member 78 may be made of any suitable material, such as plastic, and facilitates threading of the belt 34 through the housing by first passing the threading element 78 through the tunnel.

Figure 11:
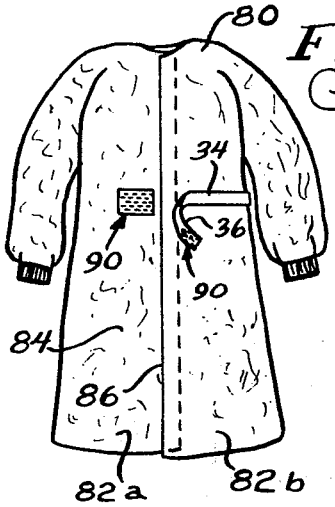
FIGS. 11 and 12 are perspective views showing the belt assembly of the present invention as attached to a disposable gown.
Figure 12:
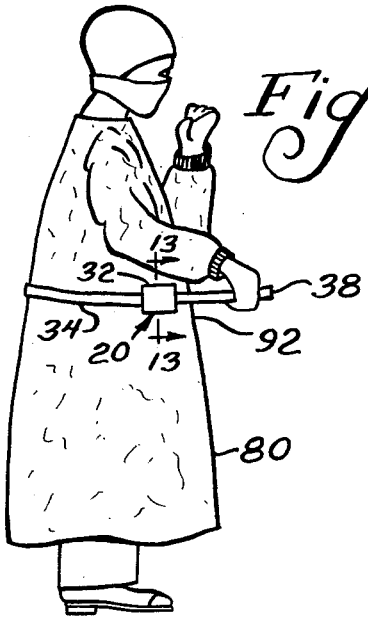
Figure 13:
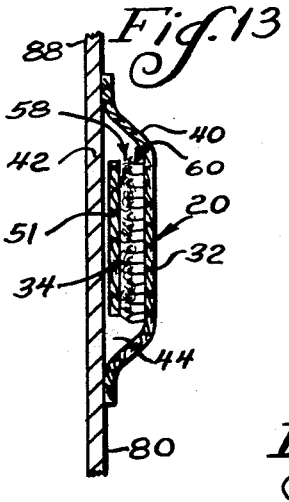
FIG. 13 is a fragmentary sectional view of the belt assembly taken substantially as indicated along the line 13—13 of FIG. 12.

Another embodiment of the belt assembly 20 is illustrated in FIGS. 11–13 for use on a garment 80, such as a disposable operating room gown. The garment or gown 80 has a pair of side margins 82*a* and 82*b* on a back 84 of the gown 80 defining an opening 86 in the gown back 84 to permit placement of the gown 80 on a wearer, such as a surgeon. As shown in FIGS. 12 and 13, the outer housing section 40 is attached to material or fabric 88 on the front 92 of the gown, such that the material 88 forms the inner section 42 of the housing 32, with the belt being prethreaded through the housing. Thus, the outer section 40 and inner section 42 of material 88 define a tunnel 44 through which the belt 34 passes. In the embodiment shown, the surface restraining means 58 on the belt 34 faces toward the outer housing section 40 and comprises a loop fastening strip, while the surface restraining means 60 on the outer housing section 40 comprises a hook fastening strip.

Referring to FIG. 11, the end 36 of the belt 34 and the side margin 82*a* of the gown back 84 include securing means generally designated 90 for attaching the belt end 36 to the gown margin 82*a*. The securing means 90 may be of any suitable type, such as hook and loop fastening strips, as shown. After the gown has been donned by the wearer, the side margins 82*a* and *b* of the gown back 84 are closed around the wearer by pressing the securing means 90 of the belt end 36 against the associated securing means on the gown side margin 82*a*, such that the securing means 90 are attached together and the belt end 36 is secured to the gown margin 82*a*. At this time, the wearer merely tugs on the belt end 38 while holding the outer housing section 40 in order to release the interengaging hook and loop fastening strips in the gown housing and to draw the belt 34 through the housing 32. In this manner, the belt may be adjusted until it has been closed a sufficient amount around the gown, after which the belt end 38 is released and the belt housing 32 maintains the belt at the selected position through interengagement of the hook and loop fastening strips.

Figure 14:
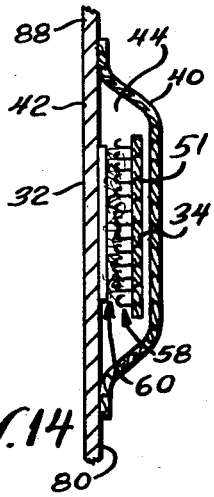
FIG. 14 is a fragmentary sectional view of another embodiment of the belt assembly of the present invention.

Another embodiment of the present invention is illustrated in FIG. 14 in which like reference numerals designate like parts. In this embodiment, the surface means 58 of the belt 34 faces toward the material 88 or inner section 42 of the gown 80. The surface means 60 on the material 88 in the tunnel 44 comprises a loop fastening strip, while the surface means 58 on the belt 34 comprises a hook fastening strip. The belt and housing surface means cooperate in a manner as previously described to permit selective adjustment of the belt in the housing.

Figure 15:
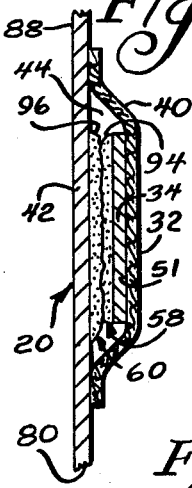
FIG. 15 is a fragmentary sectional view of another embodiment of the belt assembly of the present invention.

Another embodiment of the belt assembly 20 of the present invention is illustrated in FIG. 15, in which like reference numerals designate like parts. In this embodiment, the surface means 58 of the belt 34 faces toward the material 88 or inner section 42 of the gown or garment 80. However, in this embodiment, the surface means 58 and 60 of the belt 34 and inner housing section 42, respectively, comprise a cohesive-adhesive material defining surface portions of the belt 34 and inner section 42. Thus, the belt 34 has a coating of cohesive-adhesive material 94 defining its surface means 58 facing the inner section 42, while the inner housing section 42 has a coating of cohesive-adhesive material 96 facing toward the belt 34. The cohesive-adhesive materials 94 and 96 on the belt 34 and inner section 42 may be of any suitable type, such as crepe rubber or latex rubber, which has affinity for itself and little or no tack for surfaces other than those similar to itself. Generally, cohesive-adhesives suitable for use include aqueous emulsions or solvent solutions of rubber base adhesives, natural or synthetic. Certain acrylic base pressure sensitive adhesives may also be used, provided they are capable of bonding to themselves. The cohesive-adhesive material may be brushed on, or the material may be submerged in a bath of the cohesive-adhesive material and thereafter passed through rollers and dried. The surfaces being cohesive-adhesive material which have been cohered together provide substantial resistance against movement therealong, but can be released and thereafter re-cohered.

As before, the outer section 40 urges the belt 34 toward the inner section 42, such that the surface means 58 and 60 or cohesive-adhesive materials 94 and 96 are maintained in a relatively close interengaging relationship. The cohesive-adhesive materials 94 and 96 thus provide substantial resistance against movement of the belt 34 through the housing tunnel 44 in order to maintain the belt 34 at a selected position in the housing. However, upon applying relatively large forces against the belt 34, the interengaging cohesive-adhesive materials 94 and 96 release from each other, and permit movement of the belt 34 through the housing tunnel 44. After the belt 34 has been adjusted to the desired position and has been released, the cohesive-adhesive materials 94 and 96 again assume their frictional interengagement to maintain the belt 34 at the selected position in the housing tunnel 44. As above, the belt 34 is preferably elastic.

Figure 16:
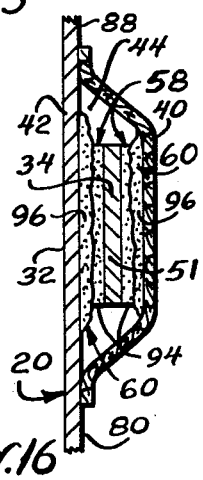
FIG. 16 is a fragmentary sectional view of another embodiment of the belt assembly of the present invention.

Another embodiment of the belt assembly 20 of the preseng invention is illustrated in FIG. 16, in which like reference numerals designate like parts. In this embodiment, the belt 34 has coatings of cohesive-adhesive material 94 on its opposed surfaces facing toward both the outer section 40 and the inner section 42 of the housing 32. Also, the outer housing section 40 has a coating of cohesive-adhesive material 96 facing toward the belt 34, and the inner housing section 42 has a coating of cohesive-adhesive material 96 facing toward the belt 34 in the housing tunnel 44. Thus, the separate sets of cohesive-adhesive coatings 94 and 96 interengage with each other in the housing tunnel to provide resistance against movement of the belt 34 through the housing, but permit movement of the belt when sufficient forces have been applied against the belt 34. In an alternative form, the cohesive-adhesive materials may be incorporated into housings of the type illustrated in FIGS. 3–6, and may be placed on one or both sides of the belt, as desired. Also, it will be apparent that the hook and loop fastening strips previously described may be positioned on both sides of the belt and on both surfaces of the housing facing the belt to provide further resistance against movement of the belt through the housing, if desired. It will be apparent that any suitable fastening means other than the snap fasteners may be used to attach the housing to the garment, such as hook and loop fastening strips.

The foregoing detailed description is given for clearness of understanding only, and no unnecessary limitations should be understood therefrom, as modifications will be obvious to those skilled in the art.

I claim:

1. Wearing apparel, comprising:

a garment;

an elongated belt;

a section of material attached to the garment and defining a tunnel to receive the belt, said belt and tunnel having surfaces comprising hook and loop fastening strips interengaging in the tunnel to permit selective adjustment of the belt relative the garment.

2. Wearing apparel, comprising:

a garment;

an elongated belt;

a section of material attached to the garment and defining a tunnel to receive the belt, said belt and tunnel having surface portions comprising a cohesive-adhesive material intergaging in the tunnel to permit selective adjustment of the belt relative the garment.

3. Wearing apparel, comprising:

(a) a garment;

(b) a belt assembly comprising, (1) a housing having first and second walls defining an elongated tunnel in the housing, with said first wall having first surface restraining means in the housing; and (2) an elongated belt passing through the housing tunnel and having second surface restraining means facing said first surface means, with the size of the tunnel between the first and second walls being sufficiently small relative the thickness of the belt for the second housing wall to maintain the second surface means of the belt in close engagement with the first surface means of the housing, said first and second surface means interengaging and cooperating to provide substantial restraint against movement of the belt through the housing tunnel and normally retain the belt at a selected position in the housing, and said first and second surface means releasing sufficiently to permit movement of the belt through the housing tunnel responsive to relatively large forces applied against the belt; and (c) means for attaching the housing to the garment.

4. The apparel of claim 3 wherein the attaching means releasably attaches one of said housing walls to said garment.

5. The apparel of claim 4 wherein the attaching means comprises at least one pair of cooperating snap fasteners.

6. The apparel of claim 3 wherein the garment comprises a stocking having a pair of boot portions for covering the legs of the wearers, and a pair of hip panels extending along the hips of the wearer, said housing and belt being attached to an upper end of said hip panels to define adjustable waist support means for the stocking.

7. The apparel of claim 6 wherein an end of the belt is attached to one of said hip panels and the housing is attached to the other of the hip panels.

8. The apparel of claim 3 wherein a material of the garment defines one of said housing walls, and in which the other housing wall is attached to the garment material.

9. The apparel of claim 3 wherein said garment comprises a disposable gown having margins defining an opening on the back of the gown, said housing being attached to the gown adjacent a front of the gown, and including means for selectively attaching a portion of the belt to the gown back on a side of the opening with the belt passing around the opening.

* * * * *